US009634437B2

(12) United States Patent
Kao et al.

(10) Patent No.: US 9,634,437 B2
(45) Date of Patent: Apr. 25, 2017

(54) ELECTRICAL RECEPTACLE CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Wen-Hsien Tsai, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/839,212

(22) Filed: Aug. 28, 2015

(65) Prior Publication Data

US 2016/0064866 A1 Mar. 3, 2016

(30) Foreign Application Priority Data

Aug. 29, 2014 (TW) ..... 103130043 A

(51) Int. Cl.

| | |
|---|---|
| ***H01R 24/00*** | (2011.01) |
| ***H01R 13/6596*** | (2011.01) |
| ***H01R 13/6461*** | (2011.01) |
| *H01R 12/72* | (2011.01) |

(52) U.S. Cl.

CPC ..... *H01R 13/6596* (2013.01); *H01R 13/6461* (2013.01); *H01R 12/724* (2013.01)

(58) Field of Classification Search

CPC ..... H01R 13/2442; H01R 13/631; H01R 23/7005; H01R 23/7073

USPC ..... 439/626, 374, 377, 79

See application file for complete search history.

(56) References Cited

FOREIGN PATENT DOCUMENTS

| | | |
|---|---|---|
| TW | M447609 | 2/2013 |
| TW | M472346 | 2/2014 |
| TW | M493802 | 1/2015 |
| WO | WO 2009/069969 A2 | 6/2009 |

*Primary Examiner* — Phuongchi T Nguyen

(74) *Attorney, Agent, or Firm* — Muncy, Geissler, Olds & Lowe, P.C.

(57) ABSTRACT

An electrical receptacle connector includes an insulated housing, upper-row terminals, lower-row terminals, and a grounding sheet. The insulated housing includes a base portion and a tongue portion. The tongue portion is extended from one side of the base portion and has an upper surface and a lower surface. The upper-row terminals are disposed at the base portion and the tongue portion and include a ground terminal located at the upper surface The lower-row terminals are disposed at the base portion and the tongue portion and include a ground terminal located at the lower surface. The grounding sheet is disposed at the insulated housing and located between the ground terminal of the upper-row terminals and the ground terminal of the lower-row terminals. The grounding sheet includes one or more protruded portion in contact with the ground terminal of the upper-row terminals or the ground terminal of the lower-row terminals.

19 Claims, 11 Drawing Sheets

100

| | | | | | | | | | | | | | |
|---|---|---|---|---|---|---|---|---|---|---|---|---|---|
| GND | TX1+ | TX1− | VBUS | CC1 | D+ | D− | RFU | VBUS | RX2− | RX2+ | GND | 31 |
| GND | RX1+ | RX1− | VBUS | RFU | D− | D+ | CC2 | VBUS | TX2− | TX2+ | GND | 41 |

Fig. 10

ELECTRICAL RECEPTACLE CONNECTOR

CROSS-REFERENCES TO RELATED APPLICATIONS

This non-provisional application claims priority under 35 U.S.C. §119(a) on Patent Application No. 103130043 filed in Taiwan, R.O.C. on 2014 Aug. 29, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use, from the end user's point of view. Now, as technology innovation marches forward, new kinds of devices, media formats and large inexpensive storage products are converging. They require significantly more bus bandwidth to maintain the interactive experience that users have come to expect. In addition, user applications demand a higher performance between the PC and sophisticated peripherals. The transmission rate of USB 2.0 is insufficient. Consequently, faster serial bus interfaces, such as USB 3.0, have been developed to address the need by adding a higher transmission rate to match usage patterns and devices.

An existing USB electrical receptacle connector includes flat terminals while an existing USB electrical plug connector includes flexible terminals, so that the existing USB electrical receptacle connector is electrically connected with the existing USB electrical plug connector via the contact between the flat terminals and the flexible terminals so as to transmit signals.

The size of the existing USB Type-C electrical receptacle connector is quite small, and the terminals therein are close to each other. Consequently, upon transmitting high-frequency signals, interference from the crosstalk between the terminals would easily affect signal transmission quality. In view of this, a baffle plate is disposed at the tongue portion of the existing USB electrical receptacle connector, the baffle plate is connected to a circuit board for noise conduction and grounding, and the baffle plate is disposed between the terminals to attenuate the interference between the terminals. However, the interference between the terminals still cannot be reduced effectively even when the baffle plate is applied to the connector. It is therefore necessary to establish and develop a new architecture of USB connectors to address the previously mentioned needs of platforms and devices, while retaining all of the functional benefits of USB that form the basis for this most popular of computing device interconnects.

SUMMARY OF THE INVENTION

In view of this, an embodiment of the instant disclosure provides an electrical receptacle connector comprising a metallic shell, an insulated housing, a plurality of upper-row terminals, a plurality of lower-row terminals, and a grounding sheet. The metallic shell defines a receptacle cavity. The insulated housing is received in the receptacle cavity and comprises a base portion and a tongue portion. The tongue portion is extended from one side of the base portion. The tongue portion has an upper surface and a lower surface opposite to the upper surface. The upper-row terminals comprise a plurality of signal terminals, at least one power terminal, and at least one ground terminal. Each of the upper-row terminals is held in the base portion and disposed at the upper surface. The lower-row terminals comprise a plurality of signal terminals, at least one power terminal, and at least one ground terminal. Each of the lower-row terminals is held in the base portion and disposed at the lower surface. The grounding sheet is disposed at the insulated housing and located between the ground terminal of the upper-row terminals and the ground terminal of the lower-row terminals. The grounding sheet comprises at least one protruded portion being in contact with the ground terminal of the upper-row terminals or the ground terminal of the lower-row terminals.

Another embodiment of the instant disclosure further provides an electrical receptacle connector comprising a metallic shell, an insulated housing, a plurality of upper-row terminals, a plurality of lower-row terminals, and a grounding sheet. The metallic shell defines a receptacle cavity. The insulated housing is received in the receptacle cavity and comprises a base portion and a tongue portion. The tongue portion is extended from one side of the base portion. The tongue portion has an upper surface and a lower surface opposite to the upper surface. The upper-row terminals comprise a plurality of signal terminals, at least one power terminal, and at least one ground terminal. Each of the upper-row terminals is held in the base portion and disposed at the upper surface. The lower-row terminals comprise a plurality of signal terminal, at least one power terminal, and at least one ground terminal. Each of the lower-row terminals is held in the base portion and disposed at the lower surface. The grounding sheet is disposed at the insulated housing and located between the ground terminal of the upper-row terminals and the ground terminal of the lower-row terminals. At least one protruded portion is disposed on the ground terminal of the upper-row terminals or the ground terminal of the lower-row terminals and in contact with the grounding sheet.

In conclusion, the grounding sheet is in contact with the ground terminal of the upper-row terminals or the ground terminal of the lower-row terminals through the protruded portions, so that the noises among the signal terminals are effectively conducted and grounded through the ground terminals. Alternatively, since the grounding sheet is connected to the ground of a circuit board to conduct and ground the noises, the noises and the crosstalk interferences of the electrical receptacle connector can be reduced. Additionally, because the grounding sheet is sandwiched between the upper-row terminals and the lower-row terminals, and the grounding terminals are respectively located at the outermost portions of the upper-row terminals and lower-row terminals, the signal terminals are grounded so that the crosstalk interferences among the signal terminals can be reduced. Next, the structural strength of the tongue portion can be improved by the assembly of the grounding sheet and the tongue portion. Furthermore, since the through hole is opened on the bottom plane of the first mount, the protruded portion extends out of the through hole to contact the ground terminal of the upper-row terminals, and sufficient contact between the ground terminal of the upper-row terminals and the grounding sheet can be accomplished. Furthermore, pin-assignments of the upper-row receptacle terminals and the lower-row receptacle terminals are 180 degree symmetrical, dual or double orientation design which enable an electrical plug connector to be inserted into the electrical receptacle connector in either of two intuitive orientations, i.e., in either upside-up or upside-down directions. In other words, the pin-assignments of the upper-row receptacle terminals and the lower-row receptacle terminals have 180 degree symmetrical, dual or double orientation design with respect to a central point of the receptacle cavity as the symmetrical center. Consequently, an electrical plug connector is inserted into the electrical receptacle connector with a first orientation where the upper surface of the tongue portion is facing up, for transmitting first signals. Conversely, the electrical plug connector is inserted into the electrical receptacle connector with a second orientation where the upper surface of the tongue portion is facing down, for transmitting second signals. Furthermore, the specification for transmitting the first signals is conformed to the specification for transmitting the second signals.

Detailed description of the characteristics and the advantages of the instant disclosure is shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 10 is a schematic configuration diagram of the terminals of the electrical receptacle connector of the exemplary embodiment.

DETAILED DESCRIPTION

Figure 1:
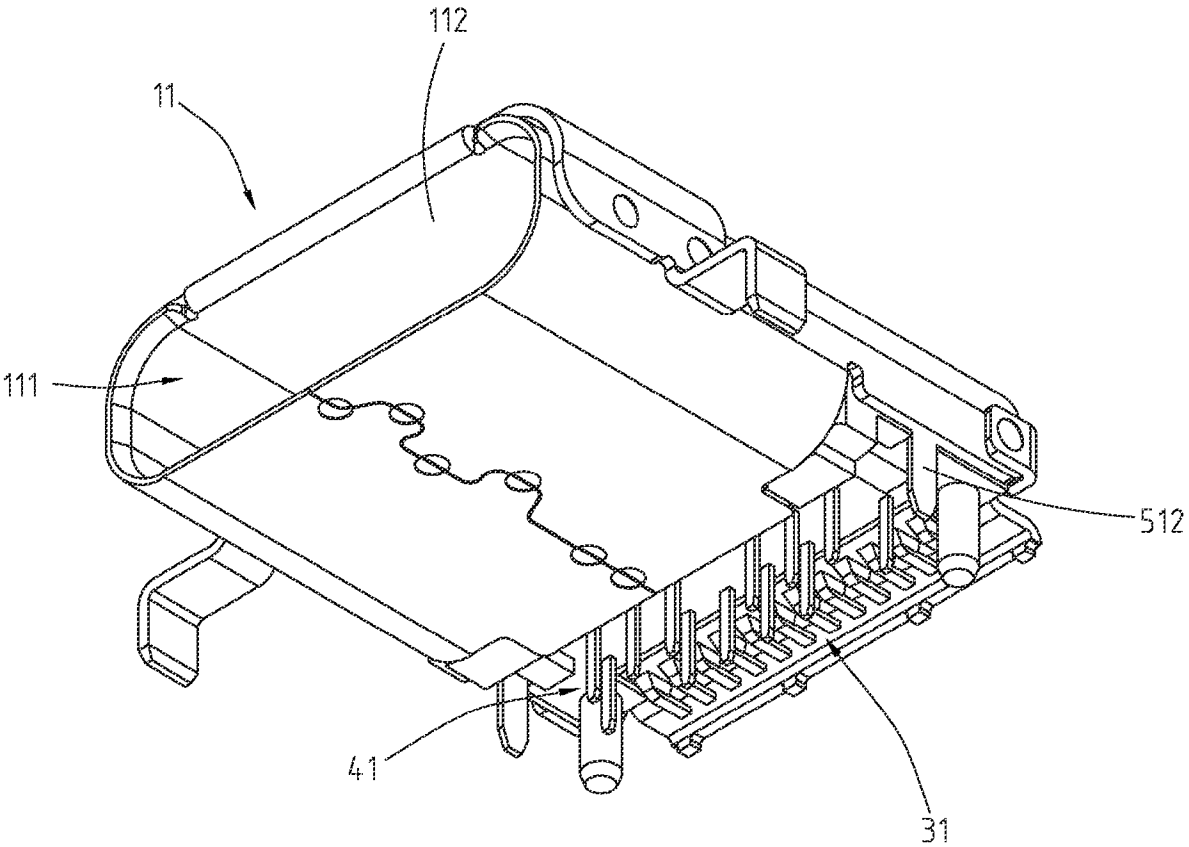
FIG. 1 is a perspective view of an electrical receptacle connector according to an exemplary embodiment of the instant disclosure.
Figure 2A:
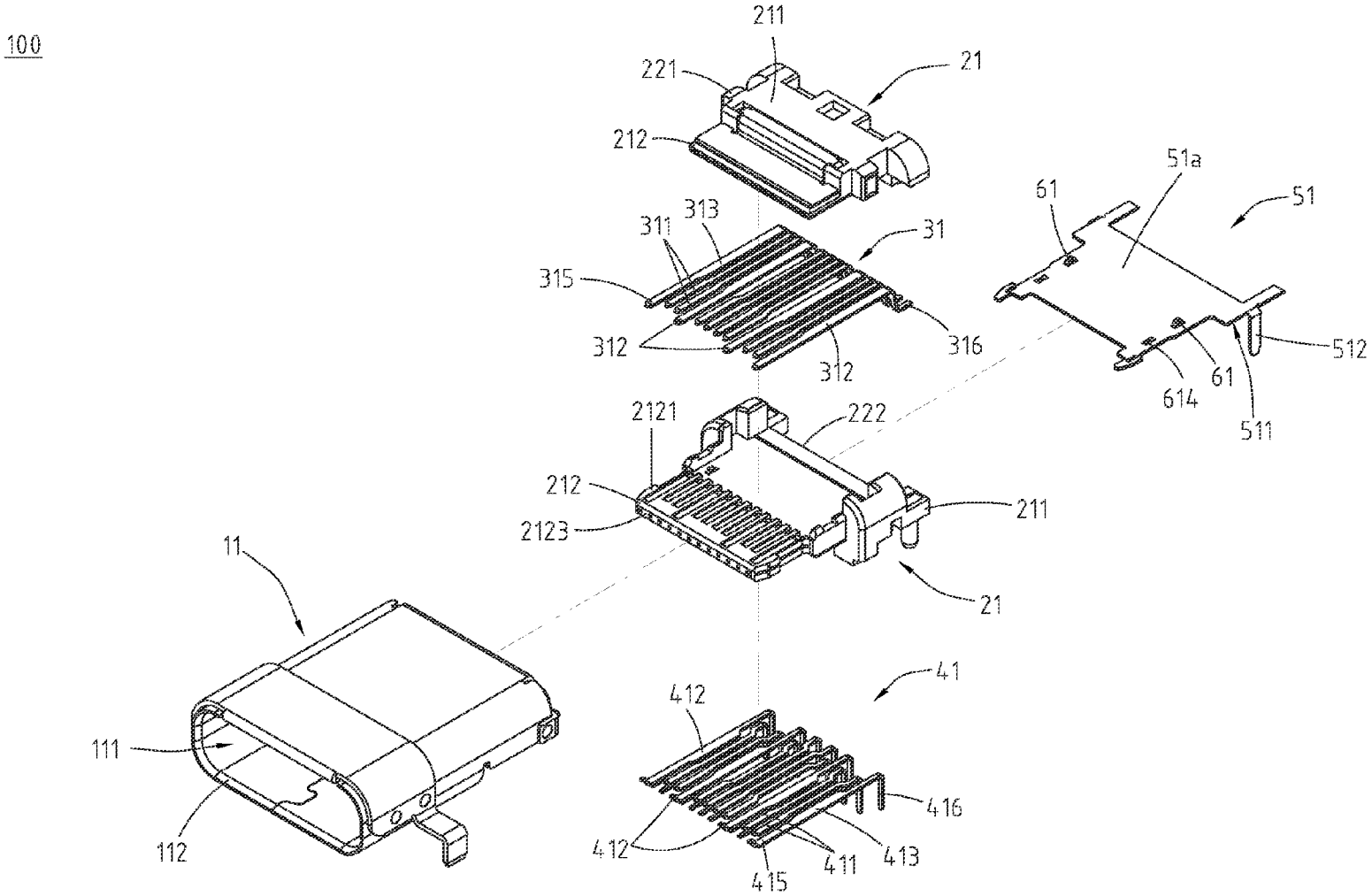
FIG. 2A is a front exploded view of the electrical receptacle connector of the exemplary embodiment.
Figure 3:
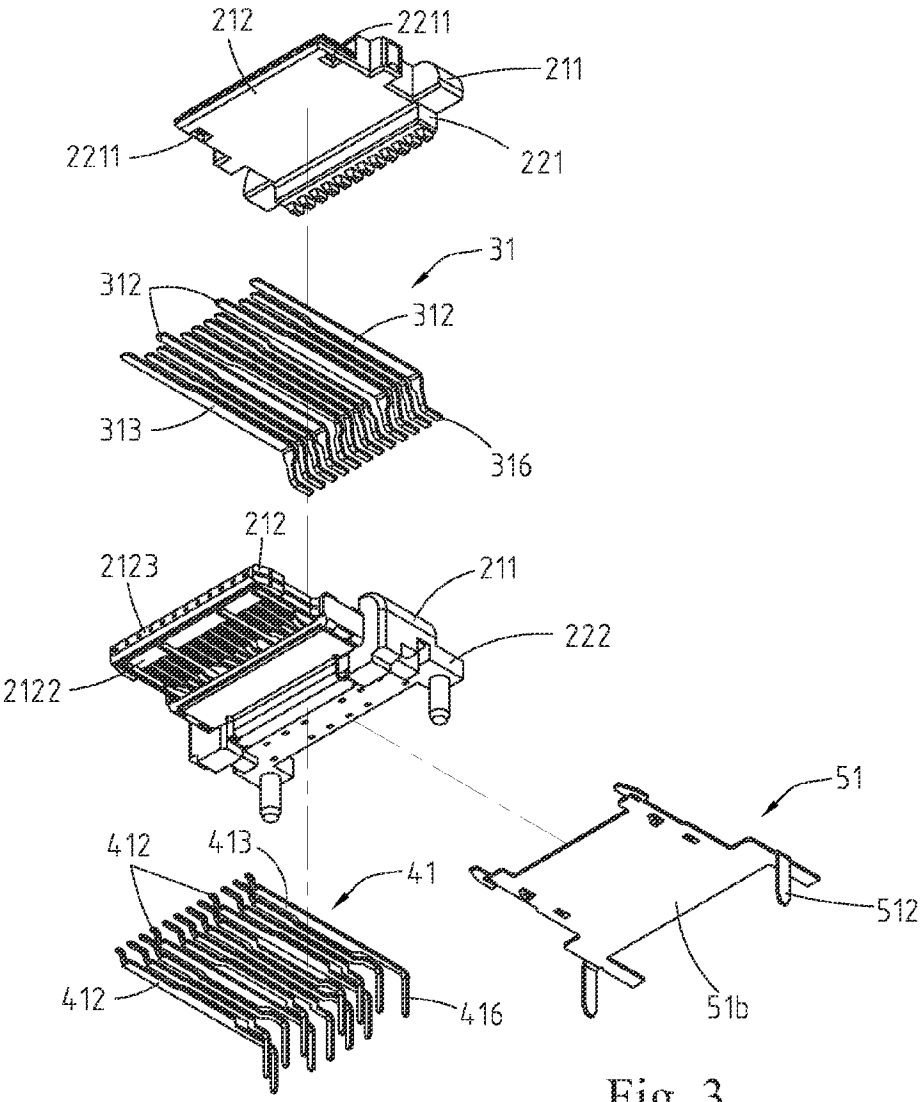
FIG. 3 is a back exploded view of the electrical receptacle connector of the exemplary embodiment in which the metallic shell is omitted.

Please refer to FIG. 1, FIG. 2A and FIG. 3, which illustrate an exemplary embodiment of an electrical receptacle connector 100 according to the instant disclosure. FIG. 1 is a perspective view of an electrical receptacle connector 100 according to an exemplary embodiment of the instant disclosure. FIG. 2A is a front exploded view of the electrical receptacle connector 100 of the exemplary embodiment. FIG. 3 is a back exploded view of the electrical receptacle connector 100 of the exemplary embodiment in which the metallic shell 11 is omitted. The electrical receptacle connector 100 described herein provides a USB Type-C connection interface. In this embodiment, the electrical receptacle connector 100 comprises a metallic shell 11, an insulated housing 21, a plurality of upper-row terminals 31, a plurality of lower-row terminals 41, and a grounding sheet 51.

Please refer to FIG. 1 and FIG. 2A, in which the metallic shell 11 is a hollowed shell and a receptacle cavity 111 is defined in the metallic shell 11. Here, the metallic shell 11 is formed by bending a unitary plate member. An insertion window 112, rectangular-shaped or oblong-shaped, is formed at one side of the metallic shell 11. Moreover, the insertion window 112 communicates with the receptacle cavity 111.

Figure 4:
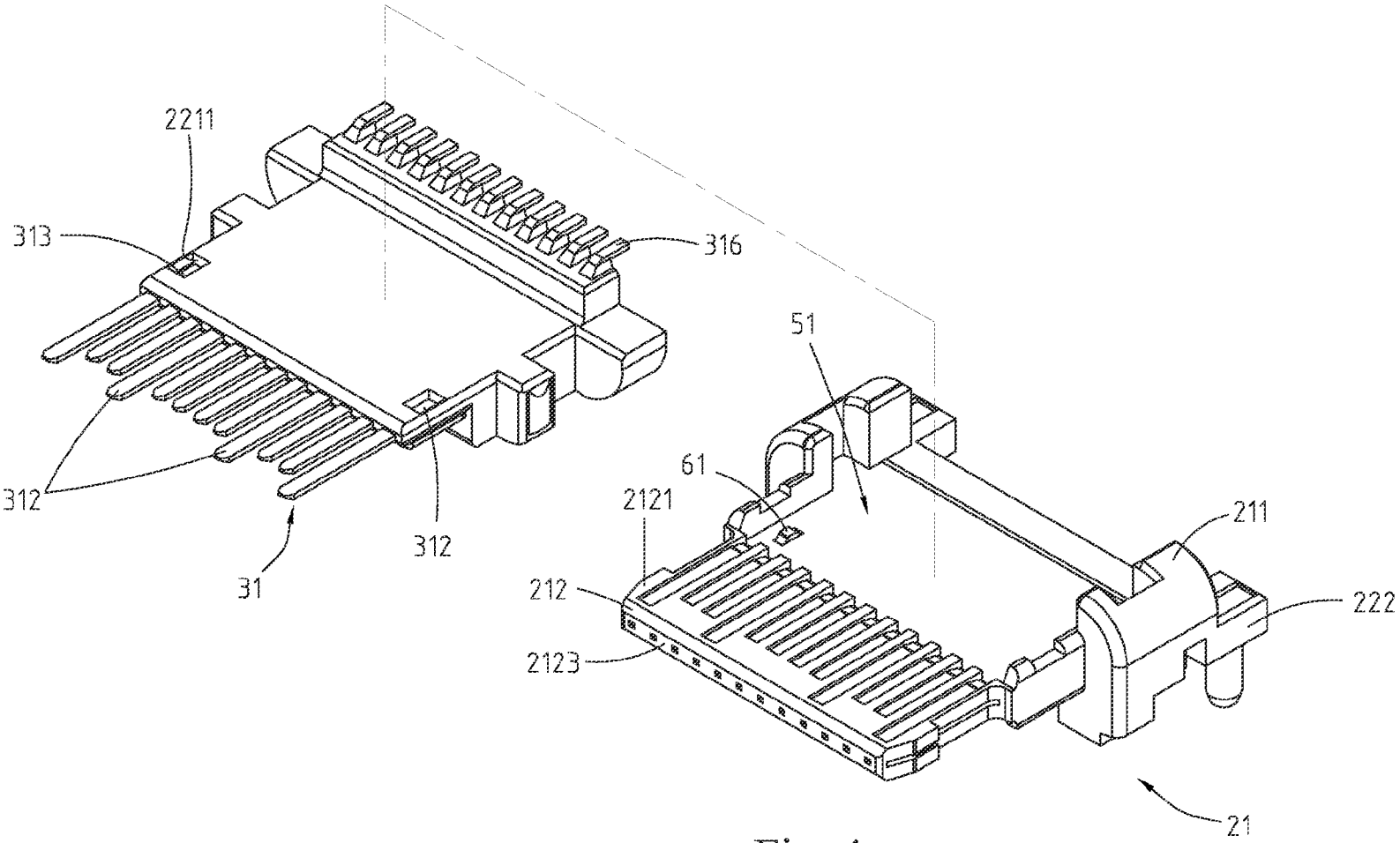
FIG. 4 is an exploded view showing a first mount detached from a second mount of the electrical receptacle connector according to the exemplary embodiment of the instant disclosure.
Figure 5:
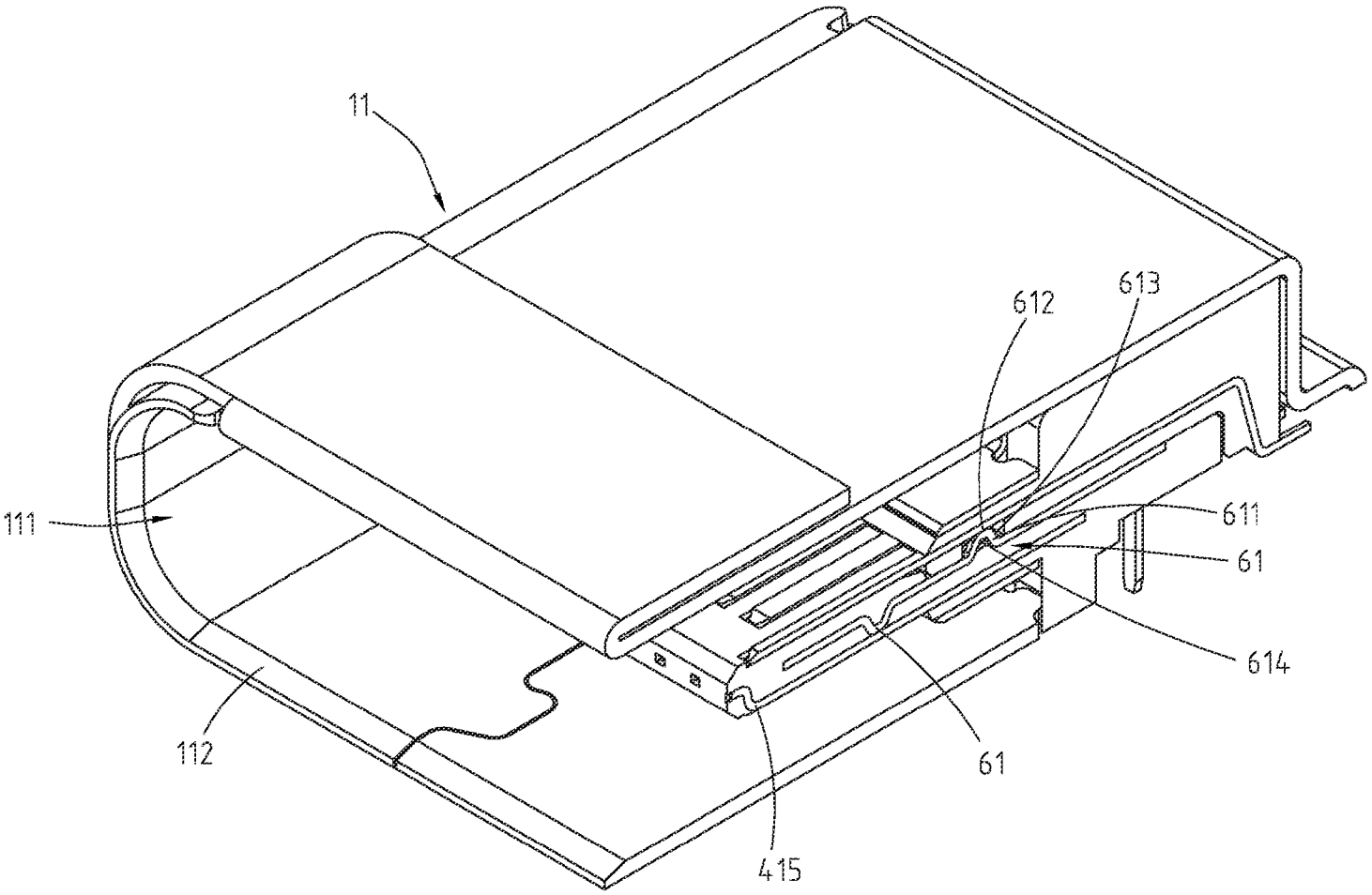
FIG. 5 is a cross-sectional view of the electrical receptacle connector of the exemplary embodiment.

FIG. 4 is an exploded view showing a first mount 221 detached from a second mount 222 of the electrical receptacle connector 100 of the exemplary embodiment. FIG. 5 is a cross-sectional view of the electrical receptacle connector 100 of the exemplary embodiment. Please refer to FIG. 4 and FIG. 5, in which the insulated housing 21 is received in the receptacle cavity 111 and covered by the metallic shell 11. The insulated housing 21 comprises a base portion 211 and a tongue portion 212 extended from one side of the base portion 211. Here, the first mount 221 and the second mount 222 are assembled with each other to form the insulated housing 21. That is, the first mount 221 and the second mount 222 are assembled with each other to form the base portion 211 and the tongue portion 212. Furthermore, the first mount 221 is substantially parts of the tongue portion 212 and the upper part of the base portion 211, and the second mount 222 is substantially the rest parts of the tongue portion 212 and the lower part of the base portion 211, but embodiments are not thus limited thereto. In some implementation aspects, the base portion 211 and the tongue portion 212 are formed integrally as a whole by injection molding techniques. Furthermore, the tongue portion 212 has an upper surface 2121, a lower surface 2122, and a front lateral surface 2123 where the upper surface 2121 is opposite to the lower surface 2122.

Please refer to FIG. 2A, FIG. 4 and FIG. 5, in which the upper-row terminals 31 are held in the base portion 211 and the tongue portion 212. Here, the upper-row terminals 31 comprise a plurality of signal terminals 311, at least one power terminal 312, and at least one ground terminal 313. Each of the upper-row terminals 31 (i.e., the signal terminals 311, the power terminal 312, and the ground terminal 313), is held in the base portion 211 and the tongue portion 212 and disposed at the upper surface 2121. Please further refer to FIG. 9 and FIG. 10, the upper-row terminals 31 comprises, from left to right, a ground terminal 313 (Gnd), a first pair of differential signal terminals (TX1+−), a second pair of differential signal terminals (D+−), and a third pair of differential signal terminals (RX2+−) of the signal terminals 311, power terminals 312 (Power/VBUS), between the three pairs of differential signal terminals, a retain terminal (RFU), (the retain terminal and a configuration channel 1 (CC1), are respectively arranged between the power terminals 312 and the second pair of differential signal terminals of the signal terminals 311), and another ground terminal 313 (Gnd). However, the pin assignment is not thus limited, and the example described above is only for illustrative purposes. That is, in practice, plural ground terminals 312 may be respectively arranged between the three pairs of differential signal terminals of the signal terminals 311. In this embodiment, twelve upper-row terminals 31 are provided for transmitting USB 3.0 signals, but embodiments are not limited thereto. In some embodiments, the far right (or far left), ground terminal 313 and the retain terminal are omitted. Additionally, the far right ground terminal 313 can be replaced by a power terminal 312 and provided for power transmission.

Please further refer to FIG. 2A, FIG. 4 and FIG. 5, in which the upper-row terminals 31 are held in the base portion 211 and the tongue portion 212. Each of the upper-row terminals 31 comprises a flat contact portion 315, a body portion, and a tail portion 316. The body portion is held in the insulated housing 21, the flat contact portion 315 is extended from one of two ends of the body portion for transmitting first signals (i.e., USB 3.0 signals), and the tail portion 316 is extended from the other end of the body portion and extended out of the base portion 211. Furthermore, the tail portions 316 are bent horizontally to form flat legs, named SMT legs which can be soldered or mounted on the surface of a circuit board using surface mount technology, as shown in FIG. 1.

Please further refer to FIG. 2A, FIG. 4 and FIG. 5, in which the lower-row terminals 41 are held in the base portion 211 and the tongue portion 212. Here, the lower-row terminals 41 comprise a plurality of signal terminals 411, at least one power terminal 412, and at least one ground terminal 413. Each of the lower-row terminals 41 (i.e., the signal terminals 411, the power terminal 412, and the ground terminal 413), is held in the base portion 211 and the tongue portion 212 and disposed at the lower surface 2122. Please further refer to FIG. 9 and FIG. 10, in which the lower-row terminals 411 comprise, from right to left, a ground terminal 413 (Gnd), a first pair of differential signal terminals (TX2+−), a second pair of differential signal terminals (D+−) and a third pair of differential signal terminals (RX1+−), of the signal terminals 411, power terminals 412 (Power/VBUS), between the three pairs of differential signal terminals, a retain terminal (RFU) (the retain terminal and a configuration channel 2 (CC2) are a respectively arranged between the power terminals 42 and the second pair of differential signal terminals of the signal terminals 411), and another ground terminal 413. However, the pin assignment is not thus limited, and the example described above is only for illustrative purposes. That is, in practice, plural ground terminals 413 may be respectively arranged between the three pairs of differential signal terminals of the signal terminals 411. In this embodiment, twelve lower-row terminals 41 are provided for transmitting USB 3.0 signals, but embodiments are not limited thereto. In some embodiments, the far right (or far left), ground terminal 413 and the retain terminal are omitted. Additionally, the far right ground terminal 413 can be replaced by a power terminal 412 and provided for power transmission.

Please further refer to FIG. 2A, FIG. 4 and FIG. 5, in which the lower-row terminals 41 are held in the base portion 211 and the tongue portion 212. Each of the lower-row terminals 41 comprises a flat contact portion 415, a body portion, and a tail portion 416. The body portion is held in the insulated housing 21, the flat contact portion 415 is extended from one of two ends of the body portion for transmitting second signals (i.e., USB 3.0 signals), and the tail portion 416 is extended from the other end of the body portion and extended out of the base portion 211. Furthermore, The tail portions 416 are extended downwardly to form vertical legs, named through-hole legs which can be soldered on the surface of a circuit board by through hole technology, as shown in FIG. 1.

In the preceding embodiments, the terminals 31, 41 are provided for transmitting USB 3.0 signals, but embodiments are not limited thereto. In some embodiments, for the upper-row terminals 31 in accordance with transmission of USB 2.0 signals, the first and third pairs of differential signal terminals (TX1+−, RX2+−), are omitted, and the second pair of differential signal terminals (D+−) and the power terminals (Power/VBUS) 312 are retained for transmitting USB 2.0 signals. While for the lower-row terminals 41 in accordance with transmission of USB 2.0 signals, the first and third pairs of differential signal terminals (TX2+−, RX1+−) are omitted, and the second pair of differential signal terminals (D+−) and the power terminals (Power/VBUS) 412 are retained for transmitting USB 2.0 signals.

Figure 9:
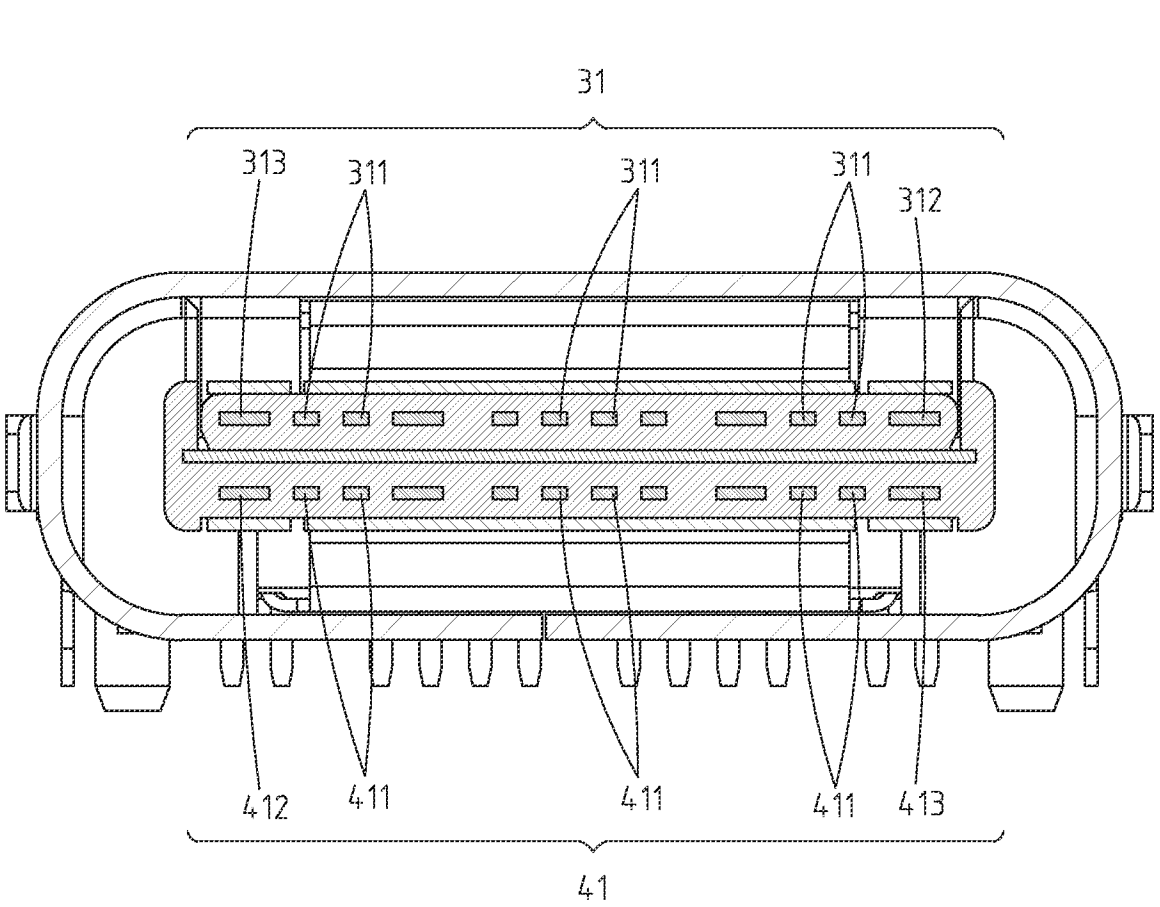
FIG. 9 is a front sectional view of the electrical receptacle connector of the exemplary embodiment.

Please refer to FIG. 9 and FIG. 10. The upper-row terminals 31 and the lower-row terminals 41 are respectively disposed at the upper surface 2121 and the lower surface 2122 of the tongue portion 212. Additionally, pin-assignments of the upper-row terminals 31 and the lower-row terminals 41 are point-symmetrical with a central point of the receptacle cavity 111 as the symmetrical center. In other words, pin-assignments of the upper-row terminals 31 and the lower-row terminals 41 have 180 degree symmetrical design with respect to the central point of the receptacle cavity 111 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the upper-row terminals 31 (or the lower-row terminals 41), are rotated by 180 degrees with the symmetrical center as the rotating center, the upper-row terminals 31 and the lower-row terminals 41 are overlapped. That is, the rotated upper-row terminals 31 are arranged at the position of the original lower-row terminals 41, and the rotated lower-row terminals 41 are arranged at the position of the original upper-row terminals 31. In other words, the upper-row terminals 31 and the lower-row terminals 41 are arranged upside down, and the pin assignments of the flat contact portions 315 are left-right reversal with respect to that of the flat contact portions 415. An electrical plug connector is inserted into the electrical receptacle connector 100 with a first orientation where the upper surface 2121 is facing up, for transmitting first signals. Conversely, the electrical plug connector is inserted into the electrical receptacle connector 100 with a second orientation where the upper surface 2121 is facing down, for transmitting second signals. Furthermore, the specification for transmitting the first signals is conformed to the specification for transmitting the second signals. Additionally, in some embodiments, the electrical receptacle connector 100 is devoid of the upper-row terminals 31 (or the lower-row terminals 41). In the case that the upper-row terminals 31 are omitted, one row of the upper-row terminals or the lower-row terminals of the electrical plug connector are connected with the lower-row terminals 41 of the electrical receptacle connector 100 when the electrical plug connector is inserted into the electrical receptacle connector 100 with the first orientation or the second orientation. Conversely, in the case that the lower-row terminals 41 are omitted, one row of the upper-row terminals or the lower-row terminals of the electrical plug connector are connected with the upper-row terminals 31 of the electrical receptacle connector 100 when the electrical plug connector is inserted into the electrical receptacle connector 100 with the first orientation or the second orientation. Note that, the inserting orientation of the electrical plug connector is not limited by the electrical receptacle connector 100 according embodiments of the instant disclosure.

Please refer to FIG. 2A, FIG. 9 and FIG. 10. With a front view of the terminals 31, 41, the pin assignment of the flat contact portions 315 correspond to that of the flat contact portions 415, but embodiments are thus not limited thereto. In some embodiments, the flat contact portions 315 are aligned by an offset with respect to the flat contact portions 415. That is, deeming the upper-row terminals 31 and the lower-row terminals 41 as two lines, the upper-row terminals 31 is shifted by an offset along the line, so that each upper-row terminal 31 approximately corresponds to a space between two adjacent lower-row terminals 41, and the flat contact portions 315, 415 respectively form two rows. Additionally, the tail portions 316 may also be shifted by the offset with respect to the tail portions 416. Based on this, during signal transmission, the crosstalk interferences between the terminals can be reduced because the flat contact portions 315, 415 are aligned in the aforementioned manner. Note that, in such embodiments, the configuration of the terminals of the electrical plug connector has to correspond to the aforementioned configuration of the upper-row terminals 31 and the lower-row terminals 41, so that the terminals of the electrical plug connector are in contact with the upper-row terminals 31 and the lower-row terminals 41 of the electrical receptacle connector 100 upon transmitting signals or electricity.

Figure 2B:
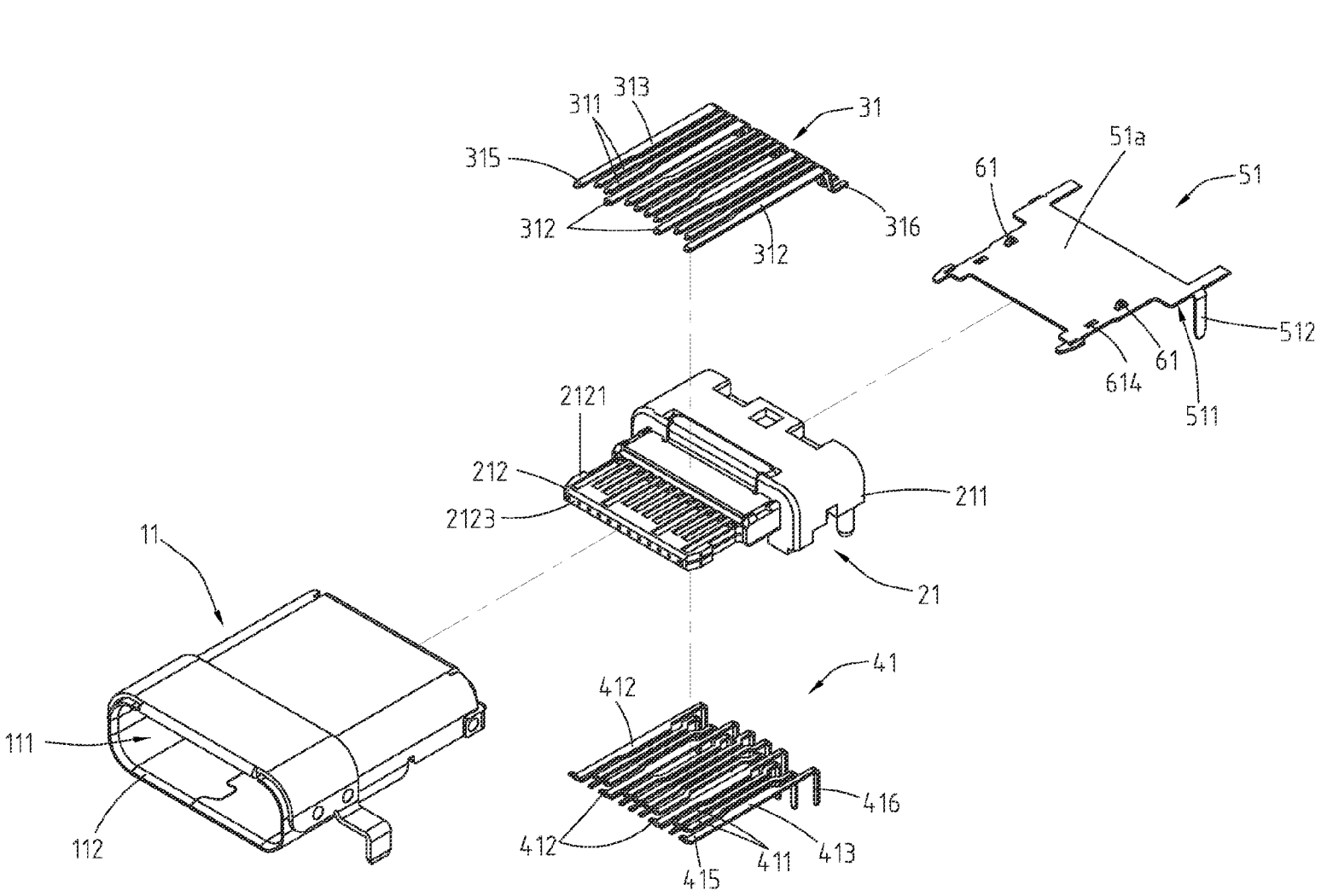
FIG. 2B is a front exploded view of the electrical receptacle connector of the exemplary embodiment, for one variation of the insulated housing.

Please refer to FIG. 2A, FIG. 4 and FIG. 5. The insulated housing 21 is a two-piece structure formed by assembling the first mount 211 and the second mount 222 with each other. The first mount 221 is combined with the upper-row terminals 31 through an insert-molding technique, and the second mount 222 is combined with the lower-row terminals 41 and the grounding sheet 51 through an insert-molding technique. Note that, the protruded portion 61 disposed at the bottom surface 51*b* of the grounding sheet 51 is in contact with the ground terminal 413. Moreover, the protruded portion 61 disposed at the bottom surface 51*b* of the grounding sheet 51 and the ground terminal 413 are disposed at the interior of the second mount 222, as shown in FIG. 5. Upon assembly, the first mount 221 is disposed on and fastened with the second mount 222. In this embodiment, the insulated housing 21 is a two-piece structure, but embodiments are not thus limited thereto. Please refer to FIG. 2B, which illustrates a front exploded view of the electrical receptacle connector 100 of the exemplary embodiment, for one variation of the insulated housing 21. Here, the first mount 221 and the second mount 222 are formed integrally as a whole, that is, the insulated housing 21 is a unitary member rather than a two-piece structure. Moreover, the upper-row terminals 31, the lower-row terminals 41, and the grounding sheet 51 are assembled on the insulated housing 21 by insert-molding technique, so that the insulated housing 21 directly combines with the upper-row terminals 31, the lower-row terminals 41, and the grounding sheet 51.

Please further refer to FIG. 3. Taking the two-piece structure as an example, at least one through hole 2211 is formed on the first mount 221, and at least one protruded portion 61 extends out of the through hole 2211 and in contact with the ground terminal 313. That is, the through hole 2211 is opened on the first mount 221 and located at the bottom plane of the first mount 2211. As shown in FIG. 4, parts of the ground terminal 313 enclosed by the first mount 221 are exposed to outside from the through hole 2211. Moreover, the position of the through hole 2211 corresponds to that of the protruded portion 61. When the first mount 221 and the second mount 222 are assembled with each other, the protruded portion 61 extends out of the through hole 2211 and is in contact with the ground terminal 313. Additionally, the front part of the grounding sheet 51 is enclosed by the front part of the second mount 222, and the rear part of the grounding sheet 51 is located at the top of the rear part of the second mount 222, i.e., the rear part of the grounding sheet 51 is not enclosed by the second mount 222, but embodiments are not limited thereto. In some embodiments, the rear part of the grounding sheet 51 is thoroughly disposed in the second mount 222, i.e., the rear part of the grounding sheet 51 is completely enclosed by the second mount 222. Specifically, whether the rear part of the grounding sheet 51 is enclosed by the second mount 222 or not, the protruded portion 61 located at the top surface 51*a* of the grounding sheet 51 is at the top of the second mount 222, thus the protruded portion 61 of the grounding sheet 51 can extend out of the through hole 2211 and be contact with the ground terminal 313 after the first mount 221 and the second mount 222 are assembled together.

Figure 6:
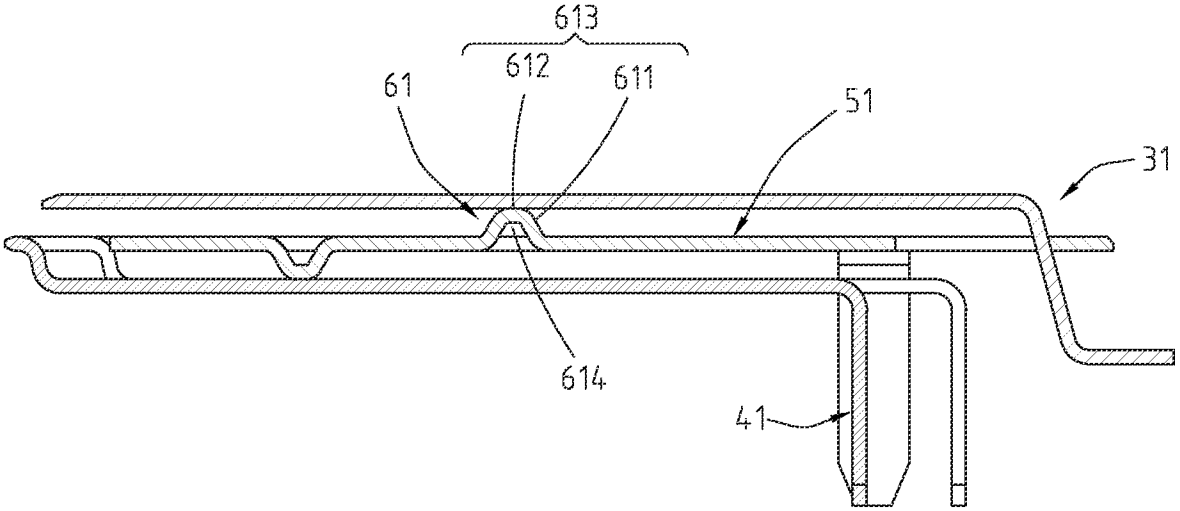
FIG. 6 is a lateral sectional view of the electrical receptacle connector of the exemplary embodiment.

FIG. 6 is a lateral sectional view of the electrical receptacle connector 100 of the exemplary embodiment. Please refer to FIG. 2A, FIG. 3 and FIG. 6. The grounding sheet 51 is a metal sheet and disposed at the insulated housing 21. Here, the grounding sheet 51 is disposed at the base portion 211 and the tongue portion 212, and the grounding sheet 51 comprises a body 511 and a plurality of legs 512 extended from one side of the body 511. The body 511 is a sheet disposed at the tongue portion 212 and located between the ground terminal 313 and the ground terminal 413. The legs 512 are extended toward two sides of the rear part of the body 511, and exposed out of the base portion 211 to be through-hole legs. Additionally, the legs 512 can be assembled to a circuit board via soldering techniques. Upon signal transmission, the grounding sheet 51 is provided to reduce the crosstalk interferences between the flat contact portions 315, 415. Next, the structural strength of the tongue portion 212 can be improved by assembling the grounding sheet 51 to the tongue portion 212.

Please refer to FIG. 2A, FIG. 3 and FIG. 6 again. A plurality of protruded portions 61 is disposed on the grounding sheet 51 and in contact with the ground terminals 313, 413, but embodiments are thus not limited thereto. In some embodiments, at least one protruded portion 61 is disposed on the grounding sheet 51 and in contact with the ground terminal 313 or the ground terminal 413. Here, the grounding sheet 51 and the protruded portions 61 are formed integrally, and the protruded portions 61 are disposed in the tongue portion 212. In this embodiment, the protruded portions 61 are formed on the top surface 51*a* and the bottom surface 51*b* of the grounding sheet 51 by machining techniques.

In this embodiment, each of the protruded portions 61 comprises a plurality of folded portions 611 and a contact plane 612. The contact plane 612 is arced and connected between the folded portions 611. The contact plane 612 and the folded portions 611 define a protruding structure. That is, the contact plane 612 is connected between two folded portions 611, and the contact plane 612 and the two folded portions 611 define a trapezoid profile structure, but embodiments are thus not limited thereto. In some embodiments, at least one folded portion 611 and a contact plane 612 are provided to define a hook structure. Here, the production of the folded portions 611 and the contact plane 612 are accomplished by stamping the grounding sheet 51, and breaches 614 are therefore formed on the grounding sheet 51. It is understood that the protruded portion 61 can be formed by other techniques, such as soldering techniques. Here, the protruded portion 61 on the top surface 51*a* of the grounding sheet 51 is in contact with the ground terminal 313, and the protruded portion 61 on the bottom surface 51*b* of the grounding sheet 51 is in contact with the ground terminal 413. Based on this, noises are conducted and grounded effectively via the ground terminals 313, 413. Alternatively, the grounding sheet 51 can be connected with a circuit board to conduct and ground the noises, thereby reducing the noises and the interference between terminals of the electrical receptacle connector 100 as low as possible.

Please refer to FIG. 4, FIG. 5 and FIG. 6. The protruded portions 61 are respectively disposed on the top surface 51*a* and the bottom surface 51*b* of the grounding sheet 51. Additionally, a distance between the protruded portion 61 disposed at the top surface 51*a* of the grounding sheet 51 and the front lateral side 2123 of the tongue portion 212 is different from a distance between the protruded portion 61 disposed at the bottom surface 51*b* of the grounding sheet 51 and the front lateral side 2123 of the tongue portion 212. Specifically, the distance between the protruded portions 61 disposed at the top surface 51*a* of the grounding sheet 51 and the front lateral side 2123 of the tongue portion 212 can be greater than the distance between the protruded portions 61 disposed at the bottom surface 51*b* of the grounding sheet 51 and the front lateral side 2123 of the tongue portion 212. In other words, the distance between the protruded portions 61 of the top surface 51*a* of the grounding sheet 51 and the base portion 211 is less than the distance between the protruded portions 61 of the bottom surface 51*b* of the grounding sheet 51 and the base portion 211, but embodiments are not limited thereto.

Figure 8:
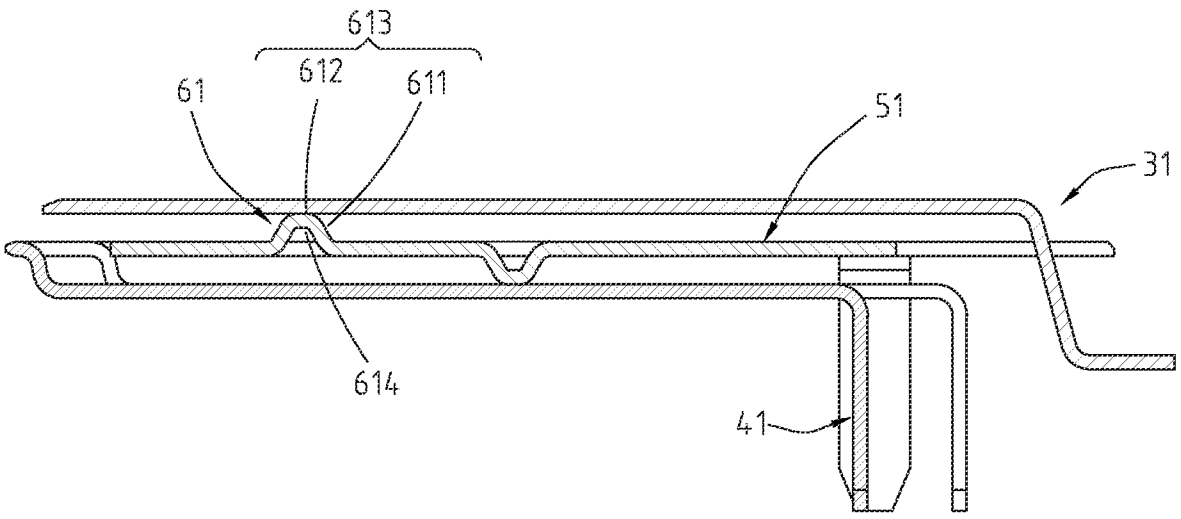
FIG. 8 is yet another lateral sectional view of the electrical receptacle connector of the exemplary embodiment.

FIG. 8 is yet another lateral sectional view of the electrical receptacle connector 100 of the exemplary embodiment. Please refer to FIG. 8. In some embodiments, the distance between the protruded portions 61 at the top surface 51*a* of the grounding sheet 51 and the front lateral side 2123 of the tongue portion 212, can be less than the distance between the protruded portions 61 at the bottom surface 51*b* of the grounding sheet 51 and the front lateral side 2123 of the tongue portion 212. That is, the distance between the protruded portions 61 at the top surface 51*a* of the grounding sheet 51 and the base portion 211 is greater than the distance between the protruded portions 61 at the bottom surface 51*b* of the grounding sheet 51 and the base portion 211. In brief, the positions of the protruded portions 61 are not limited within the front part or the rear part of the top surface 51*a* and the bottom surface 51*b*. In other words, the positions of the protruded portions 61 are not limited with a certain part of the grounding sheet 51, as long as the protruded portions 61 correspondingly contact with the ground terminal 313 and the ground terminal 413. Furthermore, in some embodiments, when the horizontal direction of the grounding sheet 51 is deemed as an X axis, a connection line of the protruded portions 61 disposed at the top surface 51*a* and the bottom surface 51*b* of the grounding sheet 51 are substantially perpendicular to the X axis, i.e., the protruded portions 61 at the top surface 51*a* of the grounding sheet 51 and the protruded portions 61 at the bottom surface 51*b* of the grounding sheet 51 are not aligned distantly, but are aligned with each other correspondingly. In detail, in such case, two protruded portions 61 are respectively on the top surface 51*a* and the bottom surface 51*b* of the grounding sheet 51 in which the two protruded portions 61 are formed at the same point of the grounding sheet 51. That is, a first protruded portion is firstly formed on the top surface 51*a* of the grounding sheet 51 by soldering or pressing techniques, and then a second protruded portion is formed on the bottom surface 51*b* of the grounding sheet by the same or like techniques, thus the two protruded portions 61 are formed on the top surface 51*a* the bottom surface 51*b* of the grounding sheet 51 and correspond to each other.

Figure 7:
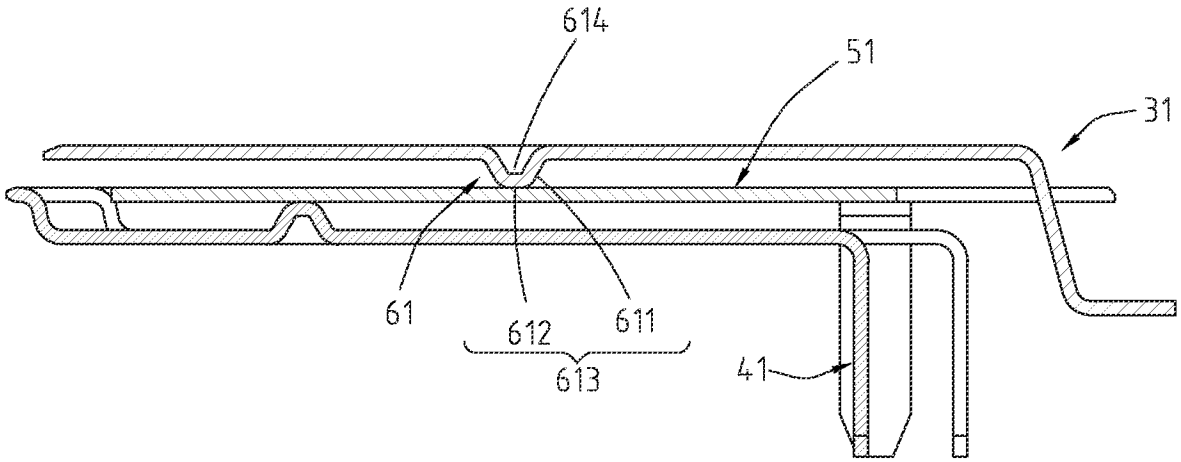
FIG. 7 is another lateral sectional view of the electrical receptacle connector of the exemplary embodiment.

Note that, the grounding sheet 51 having protruded portions 61 is an illustrative example only. FIG. 7 is another lateral sectional view of the electrical receptacle connector 100 of the exemplary embodiment. Please refer to FIG. 7, the protruded portions 61 are not disposed on the grounding sheet 51. In such embodiment, at least one protruded portion 61 is disposed on the ground terminal 313 or the ground terminal 413 and the protruded portion 61 is in contact with the grounding sheet 51. That is, the protruded portion 61 and the ground terminal 313 (or the ground terminal 413), are integrally formed as a whole. In other words, as shown in FIG. 6, the protruded portions 61 are protruded from the surface of the grounding sheet 61 to form protruding structure and are in contact with the ground terminal 313 or the ground terminal 413. Alternatively, the protruded portions 61 are protruded from the surface of the ground terminal 313 or the surface of the ground terminal 413 to from protruding structure and are in contact with the grounding sheet 51.

Accordingly, the grounding sheet is in contact with the ground terminal of the upper-row terminals or the ground terminal of the lower-row terminals through the protruded portions, so that the noises among the signal terminals are effectively conducted and grounded through the ground terminals. Alternatively, since the grounding sheet is connected to the ground of the circuit board to conduct and ground the noises, the noises and crosstalk interferences of the electrical receptacle connector can be reduced. Furthermore, because the grounding sheet is sandwiched between the upper-row terminals and the lower-row terminals, and the grounding terminals are respectively located at the outermost portions of the upper-row terminals and lower-row terminals, the signal terminals are grounded so that the crosstalk interferences among the signal terminals can be reduced. Next, the structural strength of the tongue portion can be improved by the assembly of the grounding sheet and the tongue portion. Furthermore, since the through hole is opened on the bottom plane of the first mount, the protruded portion extends out of the through hole to contact the ground terminal of the upper-row terminals, and sufficient contact between the ground terminal of the upper-row terminals and the grounding sheet can be accomplished. Furthermore, pin-assignments of the upper-row receptacle terminals and the lower-row receptacle terminals are 180 degree symmetrical, dual or double orientation design which enable an electrical plug connector to be inserted into the electrical receptacle connector in either of two intuitive orientations, i.e., in either upside-up or upside-down directions. In other words, the pin-assignments of the upper-row receptacle terminals and the lower-row receptacle terminals have 180 degree symmetrical, dual or double orientation design with respect to a central point of the receptacle cavity as the symmetrical center. Consequently, an electrical plug connector is inserted into the electrical receptacle connector with a first orientation where the upper surface of the tongue portion is facing up, for transmitting first signals. Conversely, the electrical plug connector is inserted into the electrical receptacle connector with a second orientation where the upper surface of the tongue portion is facing down, for transmitting second signals. Furthermore, the specification for transmitting the first signals is conformed to the specification for transmitting the second signals.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell, defining a receptacle cavity;

an insulated housing received in the receptacle cavity, the insulated housing comprising a base portion and a tongue portion extended from one side of the base portion, the tongue portion has an upper surface and a lower surface opposite to each other;

a plurality of upper-row terminals comprising at least one ground terminal, wherein each of the upper-row terminals is held in the base portion and disposed at the upper surface;

a plurality of lower-row terminals comprising at least one ground terminal, wherein each of the lower-row terminals is held in the base portion and disposed at the lower surface; and a shielding plate, disposed at the insulated housing and located between the upper-row terminals and the lower-row terminals, wherein the shielding plate comprises at least one protruded portion in contact with the ground terminal of the upper-row terminals or the ground terminal of the lower-row terminals, wherein the protruded portion comprises a plurality of folded portions and a contact plane disposed between the folded portions.

2. The electrical receptacle connector according to claim 1, wherein the shielding plate comprises a body and a plurality of legs extended from one side of the body and extended out of the base portion.

3. The electrical receptacle connector according to claim 1, wherein the upper-row terminals and the lower-row terminals have 180 degree symmetrical design with respect to a central point of the receptacle cavity as the symmetrical center.

4. The electrical receptacle connector according to claim 1, wherein the shielding plate is a grounding sheet.

5. The electrical receptacle connector according to claim 1, wherein the upper-row terminals further comprises a plurality of signal terminals and at least one power terminal and the lower-row terminals further comprises a plurality of signal terminals and at least one power terminal.

6. The electrical receptacle connector according to claim 1, wherein the insulated housing comprises a first mount and a second mount, the first mount and the second mount are assembled with each other to form the base portion and the tongue portion.

7. The electrical receptacle connector according to claim 6, wherein at least one through hole is opened on the first mount, the protruded portion passes through the through hole to be in contact with the ground terminal of the upper-row terminals.

8. An electrical receptacle connector, comprising:

a metallic shell, defining a receptacle cavity;

an insulated housing received in the receptacle cavity, the insulated housing comprising a base portion and a tongue portion extended from one side of the base portion, the tongue portion has an upper surface and a lower surface opposite to each other;

a plurality of upper-row terminals comprising at least one ground terminal, wherein each of the upper-row terminals is held in the base portion and disposed at the upper surface;

a plurality of lower-row terminals comprising at least one ground terminal, wherein each of the lower-row terminals is held in the base portion and disposed at the lower surface; and a shielding plate disposed at the insulated housing and located between the upper-row terminals and the lower-row terminals, wherein the shielding plate comprises at least one protruded portion in contact with the ground terminal of the upper-row terminals or the ground terminal of the lower-row terminals, wherein a plurality of protruded portions is disposed at the shielding plate, the protruded portions are respectively disposed at a top surface and a bottom surface of the shielding plate, and the protruded portions are respectively in contact with the ground terminal of the upper-row terminals and the ground terminal of the lower-row terminals.

9. The electrical receptacle connector according to claim 8, wherein a distance between one protruded portion disposed at the top surface of the shielding plate and a front lateral side of the tongue portion is different from a distance between one protruded portion disposed at the bottom surface of the grounding shielding sheet plate and the front lateral side of the tongue portion.

10. The electrical receptacle connector according to claim 8, wherein the shielding plate is a grounding sheet.

11. The electrical receptacle connector according to claim 8, wherein the upper-row terminals further comprises a plurality of signal terminals and at least one power terminal and the lower-row terminals further comprises a plurality of signal terminals and at least one power terminal.

12. An electrical receptacle connector, comprising:

a metallic shell, defining a receptacle cavity;

an insulated housing received in the receptacle cavity, the insulated housing comprising a base portion and a tongue portion extended from one side of the base portion, the tongue portion has an upper surface and a lower surface opposite to each other;

a plurality of upper-row terminals comprising at least one ground terminal, wherein each of the upper-row terminals is held in the base portion and disposed at the upper surface;

a plurality of lower-row terminals comprising at least one ground terminal, wherein each of the lower-row terminals is held in the base portion and disposed at the lower surface; and a shielding plate, disposed at the insulated housing and located between the upper-row terminals and the lower-row terminals;

wherein, at least one protruded portion is disposed on the ground terminal of the upper-row terminals or the ground terminal of the lower-row terminals and in contact with the shielding plate, and the protruded portion comprises a plurality of folded portions and a contact plane disposed between the folded portions.

13. The electrical receptacle connector according to claim 12, wherein the shielding plate comprises a body and a plurality of legs extended from one side of the body and extended out of the base portion.

14. The electrical receptacle connector according to claim 12, wherein the shielding plate is a grounding sheet.

15. The electrical receptacle connector according to claim 12, wherein the upper-row terminals further comprises a plurality of signal terminals and at least one power terminal and the lower-row terminals further comprises a plurality of signal terminals and at least one power terminal.

16. The electrical receptacle connector according to claim 12, wherein the insulated housing comprises a first mount and a second mount, the first mount and the second mount are assembled with each other to form the base portion and the tongue portion.

17. The electrical receptacle connector according to claim 16, wherein at least one through hole is opened on the first mount, the protruded portion passes through the through hole to be in contact with the ground terminal of the upper-row terminals.

18. The electrical receptacle connector according to claim 12, wherein at least two protruded portions are respectively disposed on the ground terminal of the upper-row terminals and the ground terminal of the lower-row terminals, the protruded portions are in contact with the g shielding plate.

19. The electrical receptacle connector according to claim 18, wherein a distance between the protruded portion disposed at the ground terminal of the upper-row terminals and a front lateral side of the tongue portion is different from a distance between the protruded portion disposed at the ground terminal of the lower-row terminals and the front lateral side of the tongue portion.

* * * * *